United States Patent [19]

Stefansson

[11] 4,106,766

[45] Aug. 15, 1978

[54] SHEET HANDLING AND STACKING METHODS AND APPARATUS

[75] Inventor: Rafn Stefansson, San Marino, Calif.

[73] Assignee: Bell & Howell Company, Chicago, Ill.

[21] Appl. No.: 748,624

[22] Filed: Dec. 8, 1976

[51] Int. Cl.[2] ..... B65H 29/44; B65H 31/06

[52] U.S. Cl. ..... 271/181; 271/80; 271/214; 271/263

[58] Field of Search ..... 271/177, 178, 179, 180, 271/181, 214, 80, 263, 217, 272, 274, 273

[56] References Cited

U.S. PATENT DOCUMENTS

| | | | |
|---|---|---|---|
| 2,576,152 | 11/1951 | Stimson et al. | 271/181 X |
| 2,844,373 | 7/1958 | Van Marle | 271/178 |
| 2,953,061 | 9/1960 | Pfaff | 271/272 X |
| 3,052,467 | 9/1962 | Fertig | 271/177 X |
| 3,067,999 | 12/1962 | Skeen | 271/274 |
| 3,385,598 | 5/1968 | Kim | 271/177 X |
| 3,722,773 | 3/1973 | Plate et al. | 271/263 X |

*Primary Examiner*—Bruce H. Stoner, Jr.
*Attorney, Agent, or Firm*—Benoit Law Corporation

[57] ABSTRACT

Methods and apparatus for handling or for stacking sheets provide servo power and pass the sheets seriatim from a first region to a second region. The provided servo power is transmitted through each of the sheets during passage thereof from the first region to the second region and the sheets are handled or stacked in the second region with the transmitted servo power.

9 Claims, 5 Drawing Figures

SHEET HANDLING AND STACKING METHODS AND APPARATUS

BACKGROUND OF THE INVENTION

1. Field of the Invention

The subject invention relates to sheet handling and stacking and, more specifically, to methods and apparatus for handling or for stacking sheets, such as bank checks, invoices, data and other cards, documents, copying or duplicating machine sheets and the like.

2. Description of Prior Art

In the broad context of data processing, the efficiency and feasibility of automated bank check and invoice processing have been lagging for lack of suitable equipment. In particular, prior-art sheet handling and sheet stacking methods have constituted a bottleneck in the development of sheet handling and sheet stacking techniques and equipment that would keep pace with other processing aspects concerning handled or stacked bank checks and invoices.

Similar observations apply to the processing, handling and stacking of punched and other data cards, to the processing, handling and stacking of documents, to the handling and stacking of sheets in copy machines or duplicators, and in general to other areas where sheets or sheet-like objects are handled or stacked.

In this respect, a prior-art document feeding mechanism is apparent from U.S. Pat. No. 3,095,192, by L. P. Simjian, issued June 25, 1963, and employing a plate coupled to a document feeding roller for cyclically rocking motion to permit the feeding of documents into a depository and to thereafter maintain each fed document substantially flat in the depository. This prior-art mechanism assumes the feeding progress of each document from the operation of the particular feed roller, rather than operating on the basis of the document progress itself.

According to U.S. Pat. No. 3,061,304, by J. G. Smith, issued Oct. 30, 1962, feeler fingers, depending downwardly by force of gravity, are employed in a sheet magazine to guide leading edges of ejected sheets downwardly to their stacked position in the magazine, to keep sheets stacked in the magazine, and to indicate when the magazine has been filled with stacked cards. A similar proposal is apparent from U.S. Pat. No. 3,847,391, by William Brant et al, issued Nov. 12, 1974. In both of these proposals, the role of the employed hold-down fingers in the stacking process is necessarily limited by the fact that the sheets advancing into the stacker must be capable of lifting and sliding under the fingers, which imposes expensive limitations on the permissible weight and force of application of the fingers on the stack.

A different kind of proposal is apparent from U.S. Pat. No. 3,847,388, by Thomas Lynch, issued Nov. 12, 1974, wherein a series of flexible flappers is drawn into the feed roller nip at the entrance of a tray and is thereupon flailed down on the sheets in the tray for driving fed sheets downwardly into the stack.

In practice, such flailing elements tend to wear faster than the remainder of the mechanism and their utility is limited by the permissible extent of their action on the sheets without deformation or damage thereof.

A more advantageous proposal has a slidable magazine and uses a plunger or thumper for incrementally actuating the slidable magazine as sheets are fed thereinto. While this proposal advantageously increases the volume of the magazines to accommodate a growing stack of sheets, the thumper actuation is burdened by the drawbacks of prior-art sheet feeding mechanisms. In this respect, reference may, for instance, be had to U.S. Pat. No. 3,672,265, by August Schwarzkopf, issued June 27, 1972, and showing photocell sensors with cooperating electrical or pneumatic motors in the context of stacking apparatus.

The failure of the prior art to develop adaptable solutions for present purposes may, for instance, be seen from U.S. Pat. Nos. 1,887,023, 2,013,153, 2,991,999, 3,739,925, 3,805,971, and 2,916,286.

SUMMARY OF THE INVENTION

It is a general object of this invention to overcome the above mentioned disadvantages.

It is a related object of this invention to provide improved methods and apparatus for handling and/or stacking sheets.

It is a germane object of this invention to provide improved methods and apparatus for handling and/or stacking sheets in a manner positively dictated by each traveling sheet itself.

It is also an object of this invention to provide improved methods and apparatus for operating thumper stackers.

It is a further object of this invention to provide improved methods and apparatus for avoiding and/or detecting jams in sheet handling or stacking equipment.

Other objects will become apparent in the further course of this disclosure.

The subject invention resides in a method of handling sheets, comprising, in combination, the steps of providing servo power, providing a roller, passing the sheets seriatim from a first region to a second region, transmitting the servo power through each of the sheets during passage thereof from the first region to the second region, picking up the transmitted servo power with the roller, and handling the sheets in the second region with the picked up servo power.

From another aspect thereof, the subject invention resides in a method of stacking sheets in a stacking area, comprising, in combination, the steps of providing servo power, providing a roller passing the sheets seriatim to the stacking area, transmitting the servo power through each of the sheets during passage thereof to the stacking area, picking up the transmitted servo power with the roller, and stacking the sheets in the stacking area with the picked-up servo power.

From another aspect thereof, the subject invention resides in a method of handling sheets, comprising, in combination, the steps of providing a drive roller, providing a nip roller, biasing the drive and nip rollers into mutual engagement, providing a servo roller disengaged from the drive and nip rollers, providing driving power, driving the drive roller with the driving power, engaging the sheets seriatim with the drive and nip rollers and exerting the driving power on each engaged sheet for driving the sheets with the exerted driving power seriatim from a first region to a second region, transmitting part of the exerted driving power as servo power through each driven sheet, picking up the transmitted servo power with the roller, and handling the sheets in the second region with the picked-up servo power.

From another aspect thereof, the subject invention resides in a method of stacking sheets in a stacking area, comprising, in combination, the steps of providing a drive roller, providing a nip roller, biasing the drive and nip rollers into mutual engagement, providing a servo roller disengaged from the drive and nip rollers, providing driving power, driving the drive roller with the driving power, engaging the sheets seriatim with the drive and nip rollers and exerting said driving power on each engaged sheet for driving said sheets with the exerted driving power seriatim to said stacking area, transmitting part of the exerted driving power as servo power through each driven sheet, picking up the transmitted servo power with the roller, and stacking the sheets in said stacking area with the picked-up servo power.

From another aspect thereof, the subject invention resides in a method of stacking sheets with a thumper stacker, comprising, in combination, the steps of providing servo power, providing a roller, passing the sheets seriatim to the thumper stacker, transmitting the servo power through each of the sheets during passage thereof to the thumper stacker, picking up the transmitted servo power with the roller, and operating the thumper stacker with the picked-up servo power.

From another aspect thereof, the subject invention resides in a method of stacking sheets with a thumper stacker, comprising, in combination, the steps of providing a drive roller, providing a nip roller, biasing the drive and nip rollers into mutual engagement, providing a servo roller disengaged from the drive and nip rollers, providing driving power, driving the drive rollers with the driving power, engaging the sheets seriatim with the drive and nip rollers and exerting the driving power on each engaged sheet for driving the sheets seriatim to the thumper stacker, transmitting part of the exerted driving power as a servo power through each driven sheet, picking up the transmitted servo power with the roller, and operating the thumper stacker with the picked-up servo power.

From another aspect thereof, the subject invention resides in apparatus for handling sheets, comprising, in combination, means for passing the sheets seriatim from a first region to a second region, means for providing servo power, means connected to the servo power providing means for transmitting the servo power through each of the sheets during passage thereof from the first region to the second region, roller means for receiving the transmitted servo power from each sheet, and means connected to the roller means for handling the sheets in the second region with the received servo power.

From another aspect thereof, the subject invention resides in apparatus for handling sheets, comprising, in combination, means for providing driving power, means connected to the driving power providing means for exerting the driving power on the sheets and driving the sheets with the exerted driving power seriatim from a first region to a second region, roller means operatively associated with the exerting means through each driven sheet, and means connected to the deriving means for handling the sheets in the second region with the derived servo power.

From another aspect thereof, the subject invention resides in apparatus for handling sheets, comprising, in combination, means for driving the sheets seriatim from a first region to a second region, including drive roller means for engaging each sheet, and means connected to the drive roller means for rotating the drive roller means to propel each engaged sheet to the second region, slidable means in the second region for receiving the propelled sheets, means operatively associated with the slidable means for incrementally actuating the slidable means, secondary roller means disengaged from the drive roller means, means for positioning the secondary roller, means for engagement and rotation by each sheet engaging the drive roller means, and means connected to the secondary roller means and the actuating means for transmitting operating power from the rotating secondary roller means to the actuating means.

From yet another aspect, the subject invention resides in apparatus for handling sheets, comprising, in combination, means for driving the sheets seriatim from a first region to a second region including drive roller means and nip roller means for jointly engaging each sheet, and means connected to the drive roller means for rotating the drive roller means to propel each engaged sheet to the second region, slidable means in the second region for receiving the propelled sheets, means operatively associated with the slidable means for incrementally actuating the slidable means, a pulley disengaged from the drive roller means and positioned for engagement and rotation by each sheet engaged by the drive and nip roller means, and means connected to the pulley and the actuating means for transmitting operating power from the rotating pulley to the actuating means.

BRIEF DESCRIPTION OF THE DRAWINGS

The subject invention and its various aspects and objects will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 1:
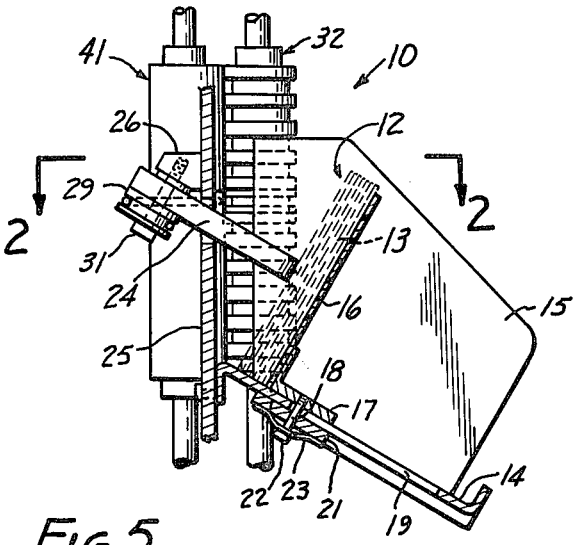
FIG. 1 is a partial elevation of a sheet handling and stacking apparatus in accordance with a preferred embodiment of the subject invention.

The sheet handling and stacking apparatus 10 shown in the drawings has a variable-volume bin 12 for receiving and stacking a plurality of sheets 13, such as bank checks, payment stubs, punched cards or other data recording cards, documents or other sheets as they exit from a data processing machine or from other sheet handling equipment (not shown). Reference may in this respect be had to the following patents herewith incorporated by reference herein: U.S. Pat. No. 2,953,372, by P. H. Williams et al, issued Sept. 20, 1960, for Check Aligning Mechanism, U.S. Pat. No. 3,107,090, by W. B. Templeton et al, issued Oct. 15, 1963, for Sheet Drive and Registering Apparatus, and U.S. Pat. No. 3,175,824, by C. A. Albosta, issued Mar. 30, 1965, for Sheet Driving and Aligning Mechanism.

However, it should be understood that the utility of the methods and apparatus of the subject invention and of its preferred embodiments is not peculiar to the sheet handling or processing equipment shown in the latter patents. In practice, the sheet handling and stacking methods and apparatus of the subject invention and of its preferred embodiments have particular utility in the handling and stacking of bank checks, payment stubs and other sheets subject to irregularities in size and condition, such as lack of flatness, presence of serrated edges and electrostatic charges which would impede, if not inhibit, satisfactory operation of stackers based on a collection of sheets under the sole force of gravity or based on another prior-art principles.

However, it should be understood that the subject invention and its preferred embodiments are also useful in the handling and/or stacking of sheets which are neither irregular nor affected by any of the above mentioned deficiencies.

The stacker bin 12 has a tray or baseplate 14, lateral walls 15 and a sheet supporting plate 16. The supporting plate 16 is slidable relative to the baseplate 14 to provide an increasing volume for the reception of an incrementally increasing number of sheets 13 in the stack on the plate 16.

To this end, the sheet supporting plate 16 is attached to a bracket 17 which, in turn, is mounted on a screw 18 that extends through a longitudinal slot 19 in the baseplate 14. In particular, the screw 18 extends loosely through a counterplate 21 and has a head 22 which retains a friction spring 23 that bears down on the counterplate 21. In this manner, the bracket 17 and counterplate 21 frictionally retain the baseplate 14 therebetween whereby the sheet supporting plate 16 is retained in position but is slidable downwardly along the baseplate 14 upon direct or indirect impact by a rotary plunger or thumper 24.

The baseplate 14 is affixed to a vertical mounting plate 25 which also carries a bracket 26. The thumper 24 is mounted for pivotal movement relative to the mounting plate or wall 25 and bracket 26 by a shaft 28 extending through the thumper 24.

The shaft or screw 28 also extends through a driven pulley 29 which is attached to the thumper 24. The upper end of the shaft 28 is attached to the bracket 26 and the lower end has the form of a head 31 which loosely retains the thumper 24 and pulley 29 adjacent the bracket 26.

Figure 2:
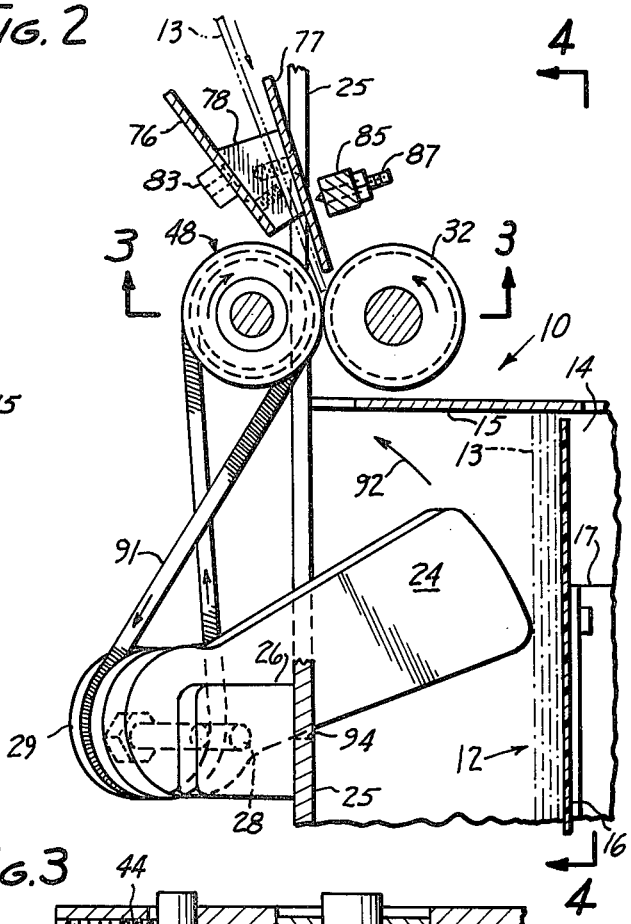
FIG. 2 is a top view on an enlarged scale, taken along the line 2—2 of FIG. 1.

Equipment for driving the sheets 13 seriatim from a first region spaced from the stacking area to a second region occupied by the thumper stacker include a drive roller 32 for engaging each sheet and a drive 33 including a motor 34 for rotating the drive roller in the direction of arrow shown in FIG. 2 on the drive roller 32 to propel each engaged sheet 13 to the second region or thumper stacker. In particular, the motor 34 drives the rotatable shaft 36 of the drive roller 32 via a drive pulley 37, a transmission belt 38 and a driven pulley 39 attached to the drive roller shaft 36.

In the illustrated preferred embodiment, the sheet driving equipment further includes a nip roller 41 being rotatable about a shaft 42. The drive roller 32 and the nip roller 41 jointly engage each advancing sheet 13 therebetween. A spring 44 held and adjusted by a set screw 45 in the frame structure 46 of the equipment acts on the nip roller shaft 42 in order to bias the nip roller 41 adjustably against the drive roller 32 for a firm engagement of each advancing sheet. The spring 44 also biases the drive roller 32 and the nip roller 41 into mutual engagement when no sheet is present therebetween, as may be seen in FIG. 1.

A pulley 48 is disengaged from the drive roller 32 and positioned at the nip roller 41 for engagement and rotation by each sheet engaged by the drive and nip rollers 32 and 41. In particular, the nip roller 41 in the illustrated preferred embodiment includes two spaced nip roller sections 51 and 52 having the pulley 48 situated therebetween for engagement by each propelled sheet 13 coming between the drive roller 32 and nip roller 41. Each nip roller section 51 and 52 has a sleeve bearing 54 or 55 rotatable about the shaft 42, and a roller body 56 or 57 located on the corresponding sleeve bearing 54 or 55 and comprising a metal, such as anodized aluminum, or other suitable roller material.

Figure 3:
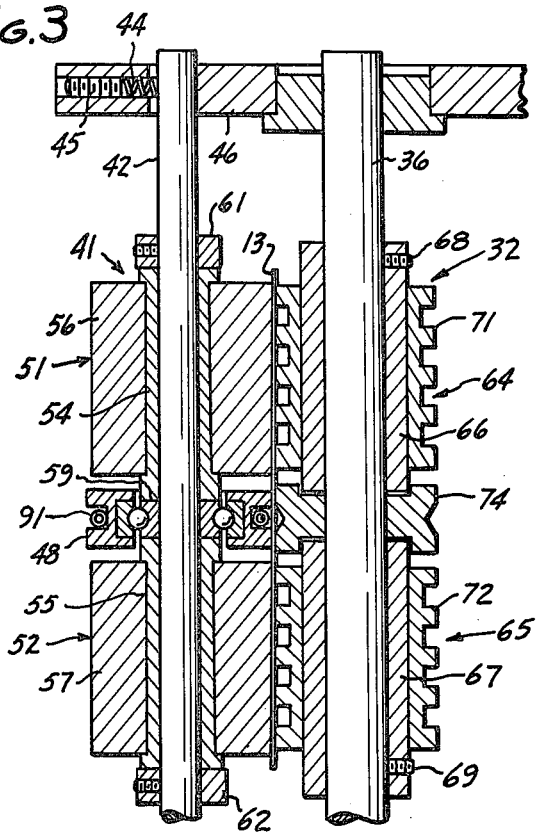
FIG. 3 is a section taken along the line 3—3 in FIG. 2.

The pulley 48 is located on a ball bearing 59 which sits on the shaft 42 between the nip roller bearing sleeves 54 and 55 so as to be freely rotatable relative to the nip roller sections 51 and 52. Set screw-equipped sleeves 61 and 62 sit on the shaft 42 to retain the nip roller assembly in place as shown in FIG. 3.

The drive roller 32 is composed of two drive roller sections 64 and 65, each having a sleeve 66 or 67 attached to the drive shaft 36 by a set screw 68 or 69 and bearing a grooved roller body 71 or 72 of rubber, a synthetic elastomer or another roller material.

A free running auxiliary roller 74 is located between the spaced drive roller sections 64 and 65 on the shaft 36. The auxiliary roller 74 may be located on the shaft 36 with a slip-fit. The auxiliary roller 74 corresponds to the pulley 48 and may serve to apply each propelled sheet 13 radially to the pulley 48.

In practice, the above mentioned data or sheet processing machine provides the sheets 13 in a serial fashion by means of a conventional conveyor belt or other sheet advancing means (not shown). Alternatively or additionally, sheets 13 may be fed manually to the rollers 32 and 41.

Each sheet 13 thus provided or fed proceeds between guide plates 76 and 77. A pair of screws 81 and 82 connects a mounting block 83 to the frame structure 46. Guide plate 76 is attached to the mounting block 83.

The guide plate 77, on the other hand, is mounted by a bracket 78 which is connected to the block 83. The guide plate 77 is resilient and flexible or deflectable.

A bar 85 is mounted in a spaced, electrically insulated relationship relative to the movable plate 77 by electric insulation 78'.

The bar 85 carries at least one contact screw having a contact tip slightly spaced from the flexible plate 77. When one or more jammed cards flex the guide plate 77 relative to the stationary guide plate 76, the plate 77 is deflected into electrical contact with the tip of the screw 87 and an electric circuit is established from the grounded plate 77 through the contact screw 87, bar 85, a terminal 88 and an alarm device or control 89 for either signaling the jammed condition or temporarily shutting down the apparatus as desired.

Each advancing sheet 13 is engaged at its leading edge by the drive and nip rollers 32 and 41 to be propelled therebetween to the thumper stacker. During such propulsion, the advancing sheet is also nipped between the pulley 48 and the free running roller 74 and a servo force or servo power is thereby transmitted through each of the sheets 13 during passage thereof from the above mentioned first region in the general area of the guide plates 76 and 77 to the second region occupied by the stacker.

If the direction in which each sheet 13 is propelled between the rollers 32 and 31 is considered a first direction, then the direction of transmission of servo power through the sheet proceeds in a second direction at right angles to that first direction.

In principle, such second direction may within the broad contemplation of the subject invention proceed through the thickness of the sheet. However, in the illustrated preferred embodiment, the second direction more nearly extends transversely of the propelled sheet, with the servo power transmitted through the sheet having a strong component substantially parallel to the width of the sheet.

In particular, the servo power in the illustrated preferred embodiments is derived by the pulley 48 through the sheet from the sheet drive power provided by the motor 34 and rotating the shaft 36 and drive roller 32 as mentioned above. The pulley 48 then acts as a pickup of the servo power which in effect proceeds to the location of the pulley transversely of each propelled sheet 13 from the roller sections 51 and 64 and 52 and 65 toward the middle of the roller arrangement where the pulley 48 and auxiliary roller 74 are situated.

The sheets 13 are thereupon handled or stacked in the second region with the transmitted servo power derived or picked up by the pulley 48.

In particular, the pulley 48 drives the thumper pulley 29 via a belt 91 which is preferably resilient in order to help store the transmitted servo power.

By way of example, the belt 91 may be composed of a helical spring, the ends of which are joined in an endless manner. Belts of this type are known as garter belts.

The thumper 24 is biased towards the sheet supporting plate 16 or, when sheets 13 are located on the plate 16, against the stack of sheets on that plate. To this end, the bracket 26 cantilevers the thumper 24 so that the thumper is made to move and to bear against the plate 16 or stack of sheets 13 by force of gravity. If desired, spring means other than the resilient belt 91 may be provided to bias the thumper 24 in a direction toward the plate 16 or stack of sheets 13. For instance, a spiral or clock spring may be used at the circular head of the thumper 24 to bias that head clockwise as seen in FIG. 2 relative to the shaft 28.

Figure 5:
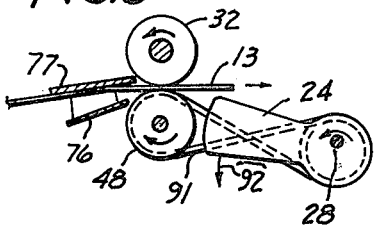
FIG. 5 is a top view diagram on a reduced scale illustrating a phase of operation of the apparatus shown in FIGS. 1 to 4.
Figure 4:
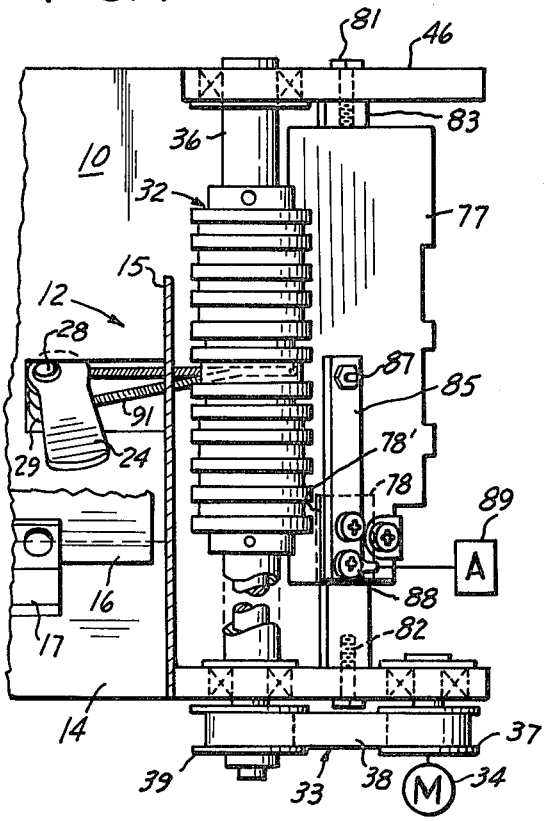
FIG. 4 is an elevation seen from the line 4—4 in FIG. 2.

The servo power transmitted through each propelled sheet 13 and picked up by the pulley 48 is stored by the thumper stacker in that the servo power transmitted from the pulley 48 by the belt 91 to the thumper pulley 29 angularly moves or rotates the thumper in the direction of the arrow 92 as indicated in FIGS. 2 and 5, whereby the derived and transmitted servo power is at least stored in the form of potential energy by the raised thumper 24.

As indicated in FIG. 5, the propelled sheet 13 is free to enter the stacker or bin 12 past the raised thumper 24. As the advancing card flies into the stacker bin 12, it leaves the drive and nip rollers 32 and 41 and thereby the servo pickup pulley 48 and auxiliary roller 74.

Pickup of the servo power thus ceases and the thumper returns to the plate 16 or stack of sheets 13 at least by force of gravity. During such downward travel, the thumper impinges on whatever card or cards are then located on the guide plate and thus incrementally moves or knocks the slidable sheet supporting plate 16 along the baseplate 18 of the stacker. This automatically increases the volume of the stacker bin 12 by an amount necessary for the reception of the next card. A stop 94 may be provided in the structural wall portion or plate 25 to limit the extent of the downward travel of the thumper 24. Also, two parallel slots 19 may be provided in the baseplate 14 and each of these may have a screw extending therethrough to avoid undesirable tilting of the sheet supporting plate 16 about an axis extending perpendicularly to the baseplate 14 as the thumper 24 incrementally knocks the supporting plate and sheet stack along the baseplate 14 during successive entries of propelled sheets into the stacker bin 12.

In accordance with an optional feature of the subject invention, the resiliency of the servo power transmission belt 91 is employed to help storing the derived servo power and to help to make the thumper 24 bear upon the propelled cards in the stacker. To this end, the thumper suspension shaft 28 extends eccentrically through the thumper pulley 29 and adjacent circular head of the thumper 24 so that a decreased radius is presented to the pulling section of the drive belt 91 as the thumper 24 is raised in the direction of the arrow 92.

The eccentric pulley 29 thus presents to the pulling section of the belt 91 a smaller radius when the thumper 24 is raised than when that thumper is in its lower position bearing against the stack of sheets 13.

At the moment when the trailing edge of a propelled sheet leaves the rollers 32 and 41 and thus servo pickup pulley 48, the tension between the pulling and pulled sections or legs of the transmission belt 91 equalizes as the pulley 48 and auxiliary roller 74 are now again free to turn. Accordingly, equal forces are exerted by the resilient belt 91 on both peripheral sides of the thumper pulley 29 where the belt 91 engages and leaves the pulley. However, because of the eccentric mounting of the pulley 29 or thumper 24 on the shaft 28, a net torque is developed via the unequal pulley radii in a sense causing a return of the thumper 24 toward the sheet stack. In other words, the resilient belt 91 acts on unequal radii or lever arms across a diameter of the pulley 29 so as to favor a return of the thumper 24 into the stacker bin.

Whether the eccentric version is used or not, it is to be observed that a garter spring-type belt provides the thumper drive with an advantageous automatic slip clutch feature, especially in the raised position of the thumper when the stacker handles relatively long cards.

Various modifications and variations within the spirit and scope of the subject invention will be suggested or rendered apparent to those skilled in the art by the subject extensive disclosure.

I claim:

1. Apparatus for handling sheets, comprising in combination:

means for driving said sheets seriatim from a first region to a second region, including drive roller means for engaging each sheet, and means connected to said drive roller means for rotating said drive roller means to propel each engaged sheet to said second region;

slidable means in said second region for receiving said propelled sheets;

means operatively associated with said slidable means for incrementally actuating said slidable means;

secondary roller means disengaged from said drive roller means;

means for positioning the secondary roller means for engagement and rotation by each sheet engaging said drive roller means; and means connected to said secondary roller means and said actuating means for transmitting operating power from said rotating secondary roller means to said actuating means.

2. Apparatus as claimed in claim 1, wherein:

said actuating means include a thumper biased in a first sense for retaining sheets in said slidable means; and said transmitting and operating means include means coupled to said thumper for moving said thumper in a second sense during rotation of said secondary roller means for clearance of said slidable means to receive any propelled sheet.

3. Apparatus as claimed in claim 2, wherein:

said transmitting and operating means include resilient power transmitting means between said secondary roller means and said thumper.

4. Apparatus as claimed in claim 3, wherein:

said transmitting and operating means include an eccentric pulley connected to said thumper and engaged by said resilient power transmitting means and presenting to said resilient power transmitting means a decreasing effective radius upon said movement of said thumper in said second sense.

5. Apparatus as claimed in claim 1, wherein:

said driving means include sensing means for sensing a jammed sheet condition at said drive roller means.

6. Apparatus as claimed in claim 1, wherein:

said driving means include a deflectable guide plate at said drive roller means; and sensing means engageable by said deflectable guide plate for sensing deflection of said guide plate by a jammed sheet.

7. Apparatus for handling sheets, comprising in combination:

means for driving said sheets seriatim from a first region to a second region including drive roller means and nip roller means for jointly engaging each sheet, and means connected to said drive roller means for rotating said drive roller means to propel each engaged sheet to said second region;

slidable means in said second region for receiving said propelled sheets;

means operatively associated with said slidable means for incrementally actuating said slidable means;

a pulley disengaged from said drive roller means and positioned for engagement and rotation by each sheet engaged by said drive and nip roller means; and means connected to said pulley and said actuating means for transmitting operating power from said rotating pulley to said actuating means.

8. Apparatus as claimed in claim 7, wherein:

said nip roller means includes two spaced nip roller sections having said pulley situated therebetween for engagement by each propelled sheet.

9. Apparatus as claimed in claim 8, wherein:

said drive roller means includes two spaced drive roller sections; and said apparatus includes a free running auxiliary roller located between said spaced drive roller sections and operatively associated with said pulley.

* * * * *